United States Patent [19]

Dieringer et al.

[11] Patent Number: 4,879,828

[45] Date of Patent: Nov. 14, 1989

[54] CONSTANT FORCE SPRING FOR CARTRIDGE MAGAZINES

[76] Inventors: Dale E. Dieringer, 7720 Teller St., Arvada, Colo. 80003; Emil Vyprachticky, 7713 Webster Way, Arvada, Colo. 80004

[21] Appl. No.: 162,186

[22] Filed: Feb. 29, 1988

[51] Int. Cl.[4] ..... F41C 25/02; F16F 1/10

[52] U.S. Cl. ..... 42/50; 267/156

[58] Field of Search ..... 42/7, 18, 22, 50; 267/155, 156

[56] References Cited

U.S. PATENT DOCUMENTS

| | | | |
|---|---|---|---|
| 345,767 | 7/1886 | Buckley | 277/199 |
| 630,503 | 8/1899 | Greenfield | 72/141 |
| 2,087,354 | 7/1937 | Muffly | 267/155 |
| 2,609,192 | 9/1952 | Lermont | 267/156 |
| 2,612,367 | 9/1952 | Blomqvist | 267/165 |
| 3,007,239 | 11/1961 | Lermont | 267/74 |
| 3,087,270 | 4/1963 | Stoner | 42/50 |
| 3,533,431 | 10/1970 | Kuenzel et al. | 137/113 |
| 4,407,006 | 9/1983 | Holick et al. | 357/65 |
| 4,580,364 | 4/1986 | Vyprachticky | 42/50 |
| 4,765,081 | 8/1988 | Dieringer | 42/50 |
| 4,776,122 | 10/1988 | Dieringer et al. | 42/50 |

FOREIGN PATENT DOCUMENTS

| | | |
|---|---|---|
| 631146 | 6/1936 | Fed. Rep. of Germany . |
| 274551 | 10/1970 | U.S.S.R. . |

*Primary Examiner*—Charles T. Jordan

*Attorney, Agent, or Firm*—Edwin L. Spangler, Jr.; Richard W. Hanes

[57] ABSTRACT

Our invention relates to an improved anti-curl feature for constant-force springs to be used in lifting a stack of shells by means of a follower in a multiple cartridge magazine for firearms thereby lessening the transverse curl in at least the uncoiled portion thereof that is responsible for causing its side margins to dig into the wall of the shell casing or bullet or both and cause jamming, such improvement comprising the localized weakening of spring along a longitudinally-extending line spaced between its side margins such that it lies flatter, preferably by providing same with a single column of longitudinally-spaced apertures or two or more such columns thereof in which adjacent pairs thereof are transversely misaligned. Our invention also encompasses the method of eliminating the aforementioned jamming problem by locally weakening the spring longitudinally such that at least its uncoiled portion lies flatter. The improved method also contemplates thickening the spring to compensate for its loss in spring force resulting from the localized weakening.

4 Claims, 2 Drawing Sheets

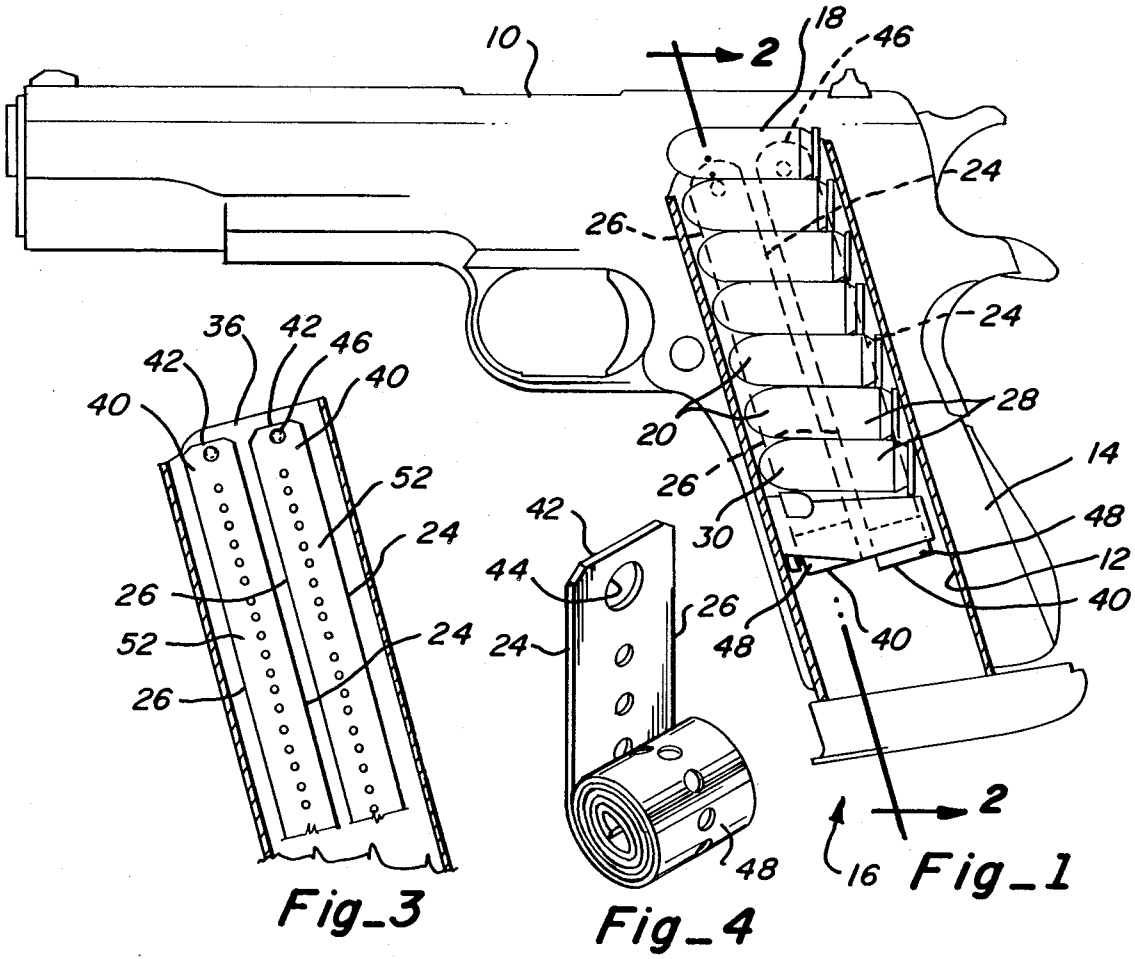
Fig_1
Fig_3
Fig_4
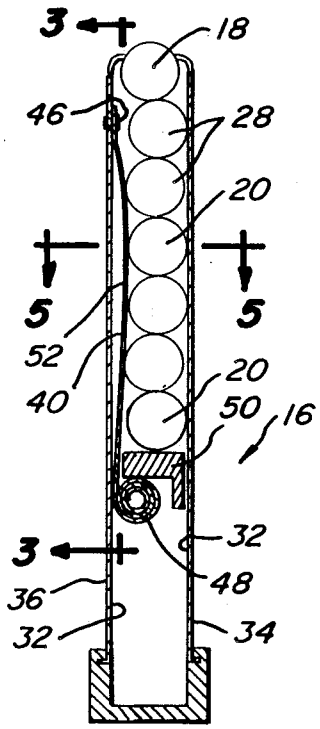
Fig_2

CONSTANT FORCE SPRING FOR CARTRIDGE MAGAZINES

BACKGROUND OF THE INVENTION

In the Vyprachticky U.S. Pat. No. 4,580,364, the many advantages derived from the use of constant force (also called "negator") springs in the design and operation of multiple-round cartridge magazines was fully explored. Then, in Dieringer application Ser. No. 052,232, now U.S. Pat. No. 4,765,081, one of us disclosed his solution to the curl problem inherent in such springs that causes the edges of the latter to dig into the cartridge casing, or bullets, or both, thus causing them to jam in certain style magazines where the tolerances are very tight. Finally, in our joint application Ser. No. 072,636, now U.S. Pat. No. 4,776,122, we jointly disclose yet another solution to the same problem having to do with curved as opposed to straight magazines. While both of these solutions to the spring curl problem work quite well and are currently in use, nevertheless, they involve certain compromises in terms of spring width, thickness, whether one or two such springs are used, and the location thereof relative to the cartridges, the sides and edges of the magazine. While all of these variables have been and are being accommodated, there remains a need for a simpler solution to the spring curl problem insofar as it relates to multiple-round cartridge magazines.

1. Field of the Invention

The present invention, therefore, relates to a novel and improved constant force anti-curl spring for use in multiple-round cartridge magazines.

2. Description of the Related Art

Transversely-slit and transversely-slotted springs are well known in the art as exemplified by the early Fuckley U.S. Pat. No. 345,767; Muffly's U.S. Pat. No. 2,087,354; Kuenzele's specialized spring forming the subject matter of his U.S. Pat. No. 3,533,431; and another old U.S. Pat. No. 630,503 issued to Greenfield. Some of the aforementioned spring structures comprise helical springs while others are circular or in some kind of leaf form. All, however, either have their side margins transversely slit alternately, first from one side and then the other or they have slots therein running transversely but not intersecting an edge. An even more highly specialized spring is the one shown in the Holick et al's U.S. Pat. No. 4,407,006 which, other than having its own peculiar chevron-shaped slot configuration, is not too much different than that of Greenfield except, of course, it is not helical and it is designed specifically for use as a semiconductor contact.

German Pat. No. 631 146 shows three versions of split tube springs having a circular cross section while Russian Pat. No. 274551 reveals a cylindrical spiral compression spring having a wave-like form. Another spring crimped transversely into a wave-like form is that forming the subject matter of Blomquist's U.S. Pat. No. 2,612,367, which spring is designed for use as a switch contact.

The closest prior art known to us is contained in the two U.S. patents to Lermont Nos. 2,609,192 and 3,007,239, both of which at FIG. 10 show a coil spring having two staggered rows of perforations 60 which are spaced apart gradually decreasing distances for the sole purpose of compensating for variations in the length of the moment arm of the force required to straighten or rewind the spirally-wound coil. None of the aforementioned references, however, teaches stress-relieving a constant force coil spring longitudinally for the purpose of lessening its transverse curl.

SUMMARY OF THE INVENTION

We have now discovered in accordance with the teaching of the instant invention that a coiled constant force spring for use in multiple-round cartridge magazines can be beneficially stress-relieved longitudinally for the purpose of reducing its transverse curl by the simple, yet unobvious, expedient of providing same with at least one and, depending upon the width of the spring, perhaps two or more transversely spaced parallel rows of longitudinally aligned but transversely misaligned apertures extending substantially the full length of its uncoiled portion.

It is, therefore, the principal object of the present invention to provide a novel and improved constant force spring especially designed for use in multiple cartridge firearm magazines.

A second objective is the provision of a device of the type aforementioned which is longitudinally stress-relieved in a localized area.

Another objective is to provide a constant force spring of the type herein disclosed and claimed which, due to its reduced transverse curl, can be made wider, or thicker, or both, so as to have the same pulling force on the magazine follower as a smaller spring without such stress-relieving feature, yet, which will fit in the same narrow space between the sidewall of the magazine and the shell casings without its edges digging into the latter.

Further objects are to provide a constant force cartridge magazine spring which is simple to manufacture, versatile, easy to install, rugged, compact, dependable and even decorative.

Other objects will be in part apparent and in part pointed out specifically hereinafter in connection with the brief description of the drawings which follows.

BRIEF DESCRIPTION OF THE DRAWINGS

FIG. 1 is a side elevation, portions of which have been broken away and revealed in section, showing a multiple-round cartridge magazine equipped with a pair of the improved constant-force springs of the present invention loaded into a .45 caliber pistol;

FIG. 2 is a section through the cartridge magazine alone taken along line 2—2 of FIG. 1;

FIG. 3 is a fragmentary section taken along line 3—3 of FIG. 2 showing the two modified constant-force springs in side-by-side relation without the stack of cartridges in front of them;

FIG. 4 is a perspective view to a greatly enlarged scale showing one of the constant-force springs partially coiled;

DESCRIPTION OF THE PREFERRED EMBODIMENTS

Figure 5:
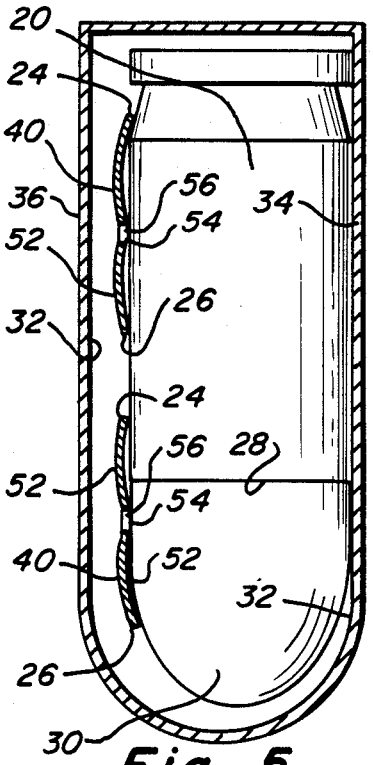
FIG. 5 is cross-sectional view to an even further enlarged scale taken along line 5—5 of FIG. 2.

Referring next to the drawings for a detailed description of the present invention and, initially, to FIGS. 1 and 2 for this purpose, reference numeral 10 has been selected to designate a firearm, in this instance a pistol, of the type having a compartment 12 in its handle 14 into which is removably inserted an multiple-round cartridge magazine which has been indicated in a general way by reference numeral 16. Other types of weapons have their cartridge magazines mounted outside the weapon except, of course, where the cartridges enter the chamber. Generally speaking, the dimensional constraints for the magazines used in this type of weapon are such that ordinary constant-force springs S of the prior art construction shown in FIG. 9 can be used for the simple reason that there is enough space available alongside the stack 18 of shells 20 to accommodate the transverse curl 22 in these springs that causes the side margins 24 and 26 thereof to dig into the cartridge casing 28 or bullet 30 or both and cause jamming. Conversely, in a firearm like pistol 10, certain rifles and rapid-fire weapons where the magazine is mounted in the handle or other restricted space, there is only so much room left between the cartridge casings 28 and inside surfaces 32 of the opposed magazine walls 34 and 36 to accommodate one or more constant force springs 36 running alongside thereof as seen in FIGS. 2, 5, and 12 through 14. The caliber of shell is fixed and this, of course, determines its outside dimension. Likewise, the space available in the magazine compartment 12 cannot be enlarged from a practical standpoint, therefore, the only possibilities left are to make the sidewalls of the magazine thinner, the springs themselves thinner and/or reduce the transverse curl in these springs.

We have already successfully made magazines with thin walls and thin springs incorporating special features that minimize the effects of transverse spring curl, one such solution involving the use of two springs in side-by-side relation instead of one and, in addition, causing their remote edges to curl respectively into the annular groove in the casing ahead of the rim and around the nose of the bullet. Unfortunately, there is only so much that can be done in this regard while retaining the requisite overall strength and ruggedness demanded in this type of product along with the necessary spring force needed to move the cartridges one-at-a-time into the chamber. Fortunately, we have now come up with a solution to the third phase of the problem, namely, the spring itself, which reduces the curl problem to manageable proportions without, at the same time, sacrificing much in the way of spring force.

Figure 14:
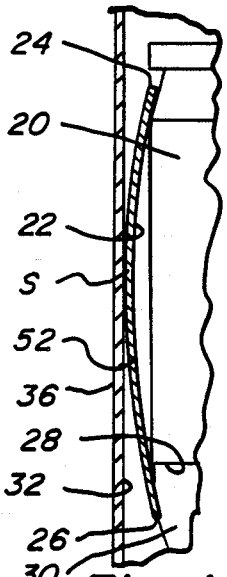
Fig 14 PRIOR ART
Figure 12:
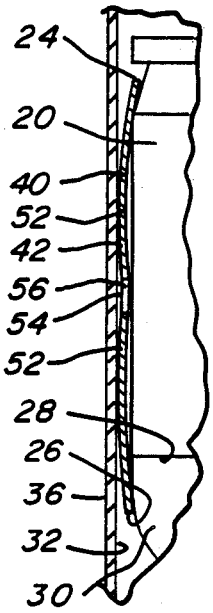
FIG. 12 is a fragmentary cross-sectional view similar to FIG. 5 showing a single wide constant force spring of the general type revealed in FIG. 9 but modified and improved to include a single column of apertures such as those shown in FIGS. 6, 8, 9 and 10.

The improved constant-force springs of the present invention have been broadly identified herein by reference numeral 40 and they can be seen in one form or another in all of the figures of the drawing with the exception of FIG. 14. In FIGS. 4 and 6 through 11, inclusive, it can be seen that one free end 42 of each spring 40 is provided with a fastener opening 44 which accepts a rivet 46 or other fastener that attaches same to a sidewall 36 of the magazine in the manner shown in FIGS. 2 and 3 near the upper open end thereof through which the cartridges are ejected into the chamber of the weapon. The other end of each such spring winds up and is coiled as shown at 48 in FIGS. 1, 2 and 4 underneath a so-called "follower" 50 which, in turn, is positioned underneath the cartridge stack 18 and functions in cooperation therewith as the coil grows larger to lift the shells one-at-a-time into the chamber. These followers may vary considerably in design and some are used with a stack of shells arranged one above another in a single row while others move stacks arranged in side-by-side or staggered columns. Regardless of the type of follower or the stacking arrangement, the problem of spring curl remains the same, especially in those magazines of the type illustrated which must fit into a compartment of fixed size.

Before getting into the specifics of the improved constant-force spring design, it might be well to look at FIG. 2 for a moment to better visualize where in the magazine the spring-curl problem occurs. With the upper free end 42 of the spring or springs fastened to a sidewall 36 of the magazine, it, for all practical purposes at least, is held out of contact with the shell casings and, therefore, causes no trouble. To a somewhat lesser extent, the same thing is true of the coiled end of the springs which uncoils as shown in FIG. 2 and emerges alongside the follower where it is more or less confined and held close to the adjacent sidewall 36. It is, therefore, the uncoiled length of spring 52 between the follower 50 and the point of spring attachment 46 where the problem occurs. In this area, the uncoiled length 52 of the spring is unconfined and it bows away from the adjacent sidewall as shown and into contact with the shell stack. More significant, however, is the fact that being unconfined, the natural transverse curl of the spring comes into play causing its side edges 24 and 26 to dig into the shell casing at one end and the bullet at the other as seen in FIG. 14. This, unfortunately, is enough to cause the shells to jam in the magazine as the relatively soft surfaces (usually brass) of the casings and the bullets try to "scrape" past these knife-like spring edges. This, of course, takes place long before there are so few shells left in the magazine that they can pass relatively unrestricted past the point of attachment of the springs at the top of the magazine where the space available widens out.

We have now discovered in accordance with the teaching found herein that the problem of constant-force spring curl in a transverse direction can be solved by the simple, yet unobvious expedient of weakening them longitudinally along one or more pathways such that their tendency to curl transversely is minimized while, at the same time, leaving their coiling force relatively undiminished by carefully avoiding any undue weakening thereof in a transverse direction which would cause them to kink. Specifically, we accomplish the foregoing by providing one or more longitudinally-extending columns 54 of small apertures 56 spaced along at least the maximum uncoiled length 52 thereof that allow the spring to relax somewhat so that its side edges 24 and 26 no longer dig into the shell casings or bullets to an extent which would result in their becoming jammed. If more than one column of apertures is used, they are preferably staggered such that no two apertures are transversely aligned.

Figure 6:
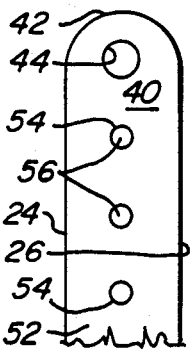
FIG. 6 is a fragmentary elevational view of the same spring shown in perspective in FIG. 4 except for slight modifications in its upper end which are of no consequence.
Figure 7:
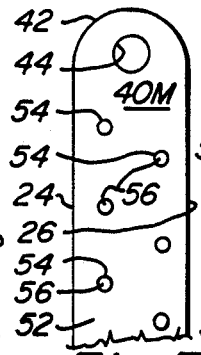
FIG. 7 is a fragmentary elevational view similar to FIG. 6 but of a modified construction in which the spring has two columns of apertures instead of just one arranged in staggered relation.
Figure 8:
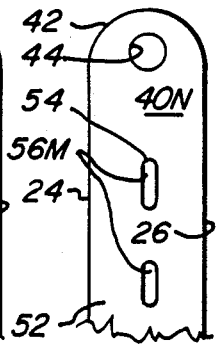
FIG. 8 is a fragmentary elevational view similar to FIGS. 6 and 7 but showing a further modified construction in which the constant-force spring has a single column of slots in place of the circular apertures.

In FIG. 5, a pair of such springs like those designated by the numeral 40 in FIG. 6 or 40N in FIG. 8 are shown positioned in side-by-side relation. By virtue of this column of apertures, they assume a shallow more or less "scalloped" shape having much less curl than their prior art counterparts shown in our earlier patents identified previously. As a result, their side margins press less tightly against the shell casings and bullets although they still contact the latter and, in addition, they make such contact at a much more acute angle thus substantially reducing the frictional forces at work. We have found that providing means for twisting the springs such that their adjacent side edges are turned outward away from the shell casing while their remote margins tend to seat at the rear end in the groove ahead of the rim and the front one curls around the nose of the bullet are no longer necessary. The wider the spring, of course, the greater the transverse curl and this is the reason we chose to use a pair of narrower springs in place of one wide one in those applications where the jamming problem was most acute. Unexpectedly, we have now discovered that even a single wide spring of the type shown in FIGS. 12 and 13 can be used in many instances to replace the pair of springs heretofore considered necessary. This is especially true of the spring 40M of FIGS. 7 and 13 containing a double row of small round apertures 56.

Figure 13:
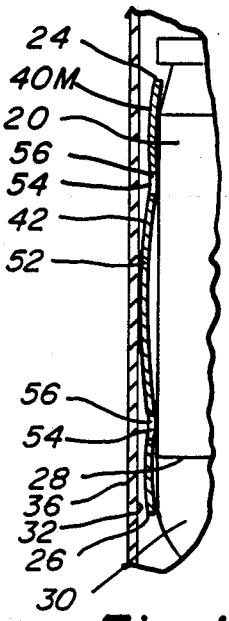
FIG. 13 is a fragmentary cross-sectional view similar to FIG. 12 but showing the single wide spring of FIG. 9 modified in accordance with FIG. 7 to include a double column of apertures; and, FIG. 14 is a fragmentary cross-sectional view similar to FIG. 5 but showing a single constant-force spring of prior art construction.

As will be seen in FIGS. 6 and 7, we have found that the size of the apertures 56 can be slightly larger if only a single column thereof is used, whereas, in a spring of the same width, a double column of apertures requires smaller individual ones if the spring force is to remain only slightly diminished. Moreover, and most important, it has been found that when a double column of apertures is used as shown in FIGS. 7 and 13, the columns should be staggered so that no two lie in transverse alignment with one another. Unless this is done, even though the apertures be very small, they so weaken the spring transversely that it has a tendency to kink, especially after repeated actuations. The closer the spacing of the apertures, the less curl found in the spring. Moreover, a spring with a double column of apertures will, depending upon their relative sizes of course, have less curl than one with a single column.

Looking at FIG. 8, on the other hand, somewhat the same effect as a double column of apertures can be achieved, especially in those applications where spring width is a problem, by replacing the double column of apertures 56 shown in FIGS. 7 and 13 with a single column of centrally-located narrow slots 56M. These slots should be considerably longer than they are wide or they have a tendency to cause the spring to twist and kink. On the other hand, mere slits have proven to be unsatisfactory because their opposed edges interfere with one another and produce kinking problems. Accordingly, in all but certain specific applications, the small round apertures are preferred to the slots.

Figure 9:
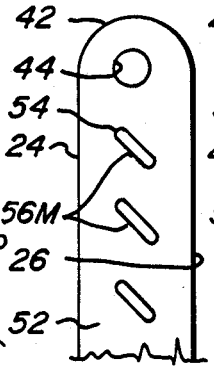
FIG. 9 is a fragmentary elevational view similar to FIG. 8 showing a further modification wherein the slots run diagonally instead of being longitudinally aligned.
Figure 10:
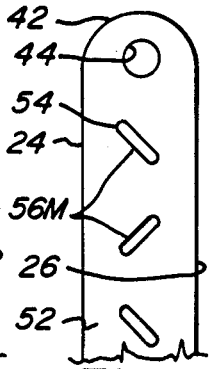
FIG. 10 is a fragmentary elevational view similar to FIG. 9 but showing the diagonal slots alternating in direction instead of all going the same direction.

In FIG. 9, a still different arrangement is shown in which the slots 56M instead of being arranged in longitudinal alignment as shown in FIG. 8 are angled relative to the side margins of the spring. They are shown parallel to one another but can be at different angles of inclination although no useful purpose is served by so doing and manufacture becomes somewhat more difficult. Still another slot arrangement is shown in FIG. 10 where the slots 56M are alternately angled, one to the right and the next to the left. Of the two, the arrangement shown in FIG. 10 is slightly preferred as the spring has less of a tendency to twist.

Figure 11:
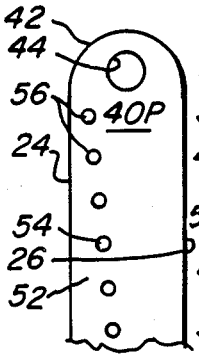
FIG. 11 is a fragmentary elevational view much like FIGS. 6 and 7 but differing therefrom in that the column of apertures runs diagonally along the spring rather than paralleling its side margins.

The last of the alternative embodiments 40P is shown in FIG. 11. It differs from that shown in FIG. 6 in that, as shown, the apertures are slightly smaller and placed closer together; however, the main difference is that the column of apertures instead of extending longitudinally of the spring in parallel relation to its side margins is angled relative to the latter so as to extend somewhat diagonally. Once this line of apertures approaches the righthand edge it could, of course, start angling back to the left much in the manner of the slots in FIG. 10. The resulting angled or zig-zag column extending in a longitudinal direction would still provide the necessary weakened area that would permit flattening of the spring to a degree where the problem illustrated in FIG. 14 is avoided.

While not illustrated specifically, in certain applications, one or more columns made up of a combination of small round apertures and narrow slots, either aligned or angled, could be the preferred answer to the curling problem. As a matter of fact, any way of localizing the weakening of the spring along one or more longitudinally-extending pathways while preserving its coiling potential without kinking will accomplish the same desirable end as placing holes in it. For example, making it thinner along a well-defined columnar location will accomplish the same result as weakening it with holes. Conceivably, this same thing could be accomplished by selectively tempering the spring in such a way that one or more "less stressed" columns exist which tend to reduce its tendency to curl in those areas while, at the same time, leaving the rest of the spring as it was. While these are possibilities, nevertheless, the simplest and most practical solution at the present time appears to us to be that of weakening selected columnar areas of the spring with apertures of a shape and size such that they do not weaken its coiling potential beyond that which can be made up by using more than one spring, a wider one or making it or them somewhat thicker.

On this last point, while it is obvious that providing a spring with apertures 56 has an effect upon the spring force it exerts when coiling, the gain in space between the sidewalls of the magazine far exceeds that which may be required by way of an increase in spring thickness to restore the lost capacity. In other words, while there is admittedly a loss in spring force, it can be replaced many times over by a minimal increase in spring thickness or width or both that is far less than that required to accommodate one or more springs without our so-called "anti-curl" feature to be placed in the very minimal space usually available. Dimensionally, we have found that a constant-force spring of the species shown in FIG. 6 which is 0.4375 inches wide and 0.005 of an inch thick can easily accommodate a column of round apertures approximately 0.0625 of an inch in diameter spaced apart about 0.500 of an inch without seriously reducing the spring force required to lift the follower driving a stack of ten or so 0.45 caliber cartridges. This amounts to an increase in spring thickness of 0.001 of an inch over a similar spring for use in the same magazine without the apertures. Preferably, if a double column of apertures like that shown in the species of FIG. 7 is used, the individual apertures can be reduced in size to a diameter of approximately 0.03125 of an inch while keeping the rest of the dimensions the same as the single column version of FIG. 6. With regard to the species of FIG. 8, the slots 56M in the same width spring were 0.03125 of an inch wide, 0.125 of an inch in length and spaced apart approximately 0.400 inches. The important thing here, however, is that the slots extend longitudinally and not laterally as in the case of the well known ring clamps for radiator hoses and the like. In a tightly-coiled constant-force spring, transverse slits or slots or even pairs of transversely aligned apertures weaken it to the point where it is virtually useless to raise the follower assuming that it can be coiled and uncoiled at all without kinking which is what all too often happens. Most important, however, is the fact that for the present application, selectively weakening the spring along transverse lines does nothing whatsoever to solve the transverse curl problem. Wider springs like those shown in FIGS. 12 and 13 can accommodate larger apertures without becoming so weakened that they cannot raise the follower or become subject to the kinking problem. The important thing to remember, however, is that there is no need to maximize the size of the apertures relative to the width and thickness of the spring since the sought after objective is merely one of lessening the transverse curl to the extent where jamming ceases to be a problem due to the side margins of the uncoiled portion digging into the wall of the shell casing, bullet or both. What this means, therefore, is that, ideally, one or more columns of apertures containing the smallest holes spaced well apart that will accomplish the aforementioned objective should be used since this will best preserve the lifting force of the spring without having to make it thicker. Obviously, as a practical matter, the choice should be a compromise between something larger than the smallest hole that will do the job in order to provide a margin of error that will insure 100% reliability coupled with a spring a few thousandths of an inch thicker than the one having no anti-curl apertures at all.

Finally, it should, perhaps, be mentioned that the columns of apertures can be confined to the uncoiled length 52 of the spring 40 and they need not extend onto that portion which remains coiled at all times. In other words, for best results the length of the spring or springs is selected for a given application such that a portion thereof remains coiled at all times. The transverse curl in this coiled portion is very minimal compared with the uncoiled portion and what does exist in the coil is of no consequence as far as the jamming problem in concerned. Therefore, the best approach is to leave the apertures out of most of that portion which remains coiled to preserve as much as possible of its potential lifting force. This is not to suggest, of course, that the full length of the spring cannot be apertured which, obviously, it can and still solve the jamming problem, but rather, that continuing the apertures onto the portion that remains coiled serves no useful purpose and thus can be done away with for this reason.

A wide range of combinations exist which will satisfy these requirements in any given application we have encountered thus far in the design and construction of multiple-cartridge magazines. While simple, nevertheless, we have found a solution to a recurrent problem in the design of multiple-cartridge magazines, especially those for use in applications where there is a very little space available for the constant-force springs needed to raise the follower and cartridge stack.

What is claimed is:

1. In a constant force spring having side margins, a coiled portion and an uncoiled portion, the improved anti-curl feature for eliminating jamming when such spring is used to lift a stack of shells in a multiple cartridge magazine by means of a follower, which comprises: at least one column of longitudinally-spaced apertures spaced inwardly of the side margins and extending substantially the full length of at least the uncoiled portion and wherein the apertures comprises elongated slots extending lengthwise or diagonally of the spring.

2. In a constant force spring having side margins, a coiled portion and an uncoiled portion, the improved anti-curl feature for eliminating jamming when such spring is used to lift a stack of shells in a multiple cartridge magazine by means of a follower, which comprises: at least one column of longitudinally-spaced apertures spaced inwardly of the side margins and extending substantially the full length of at least the uncoiled portion and wherein a single column of apertures is located midway between the side margins.

3. The improved method for lessening the transverse coil in at least the uncoiled portions of constant-force springs to be used for lifting a stack of shells in a multiple cartridge magazine by means of a follower which comprises: locally weakening the spring by providing a single column of round apertures spaced inwardly of its side margins so that its uncoiled portion lies further.

4. The improved method for lessening the transverse curl in at least the uncoiled portions of constant-force springs to be used for lifting a stack of shells in a multiple cartridge magazine by means of a follower which comprises: locally weakening the spring along one or more longitudinally-extending columns spaced inwardly of its side margins so that its uncoiled portion lies flatter and thickening the spring to compensate for the loss in spring force resulting from the localized weakening.

* * * * *